US007642446B2

(12) United States Patent
Furukawa

(10) Patent No.: US 7,642,446 B2
(45) Date of Patent: Jan. 5, 2010

(54) MUSIC SYSTEM FOR TRANSMITTING ENCIPHERED MUSIC DATA, MUSIC DATA SOURCE AND MUSIC PRODUCER INCORPORATED THEREIN

(75) Inventor: Rei Furukawa, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 754 days.

(21) Appl. No.: 10/871,470

(22) Filed: Jun. 18, 2004

(65) Prior Publication Data

US 2004/0264506 A1 Dec. 30, 2004

(30) Foreign Application Priority Data

Jun. 30, 2003 (JP) ..... 2003-186464

(51) Int. Cl.
*G10H 7/00* (2006.01)

(52) U.S. Cl. ..... 84/645; 84/601; 84/602; 84/647

(58) Field of Classification Search ..... 84/645, 84/609–611, 600–606, 613–618, 634–638
See application file for complete search history.

(56) References Cited

U.S. PATENT DOCUMENTS 5,054,360 A * 10/1991 Lisle et al. ..... 84/645
5,933,430 A * 8/1999 Osakabe et al. ..... 370/463
6,034,314 A 3/2000 Koike
6,525,253 B1 * 2/2003 Kikuchi et al. ..... 84/601
2002/0061060 A1 * 5/2002 Lukac-Kuruc et al. ..... 375/220

FOREIGN PATENT DOCUMENTS

| | | |
|---|---|---|
| JP | 63-301997 | 12/1988 |
| JP | 6-25895 | 4/1994 |
| JP | 6-195883 | 7/1994 |
| JP | 10-124046 | 5/1998 |
| JP | 10-319950 | 12/1998 |
| JP | 2001-148717 | 5/2001 |
| JP | 2002-111660 | 4/2002 |
| JP | 2003-169092 | 6/2003 |
| JP | 2003-174441 | 6/2003 |

* cited by examiner

*Primary Examiner*—Jeffrey Donels
*Assistant Examiner*—Christopher Uhlir
(74) *Attorney, Agent, or Firm*—Morrison & Foerster LLP

(57) ABSTRACT

Channel voice messages representative of a piece of music are enciphered to pieces of enciphered music data, and the pieces of enciphered music data are stored in maker exclusive messages; the maker exclusive messages are loaded into packets, and are transmitted from a server to a client; when the packets arrive at the client, the pieces of enciphered music data are restored to the channel voice messages through a reverse process so that the piece of music is produced by means of electronic musical instruments where the data restoration program has been already loaded.

6 Claims, 6 Drawing Sheets

MUSIC SYSTEM FOR TRANSMITTING ENCIPHERED MUSIC DATA, MUSIC DATA SOURCE AND MUSIC PRODUCER INCORPORATED THEREIN

FIELD OF THE INVENTION

This invention relates to enciphered music data communication technologies and, more particularly, to a music system for producing a music passage, a music data source and a music producer incorporated in the music system.

DESCRIPTION OF THE RELATED ART

There are various sorts of data allotting service through communication networks such as the internet. The standard MIDI (Musical Instrument Digital Interface) file is a typical example of the music data, and various music contents are selectively allotted from a server to users through the communication network in the form of the standard MIDI files. For example, when a user requests the server to supply a standard MIDI file to his or her personal computer system, the server allots the standard MIDI file to the user's personal computer system through the internet for pay. Upon reception of the standard MIDI file, the user transfers the standard MIDI file from the personal computer system to an electronic musical instrument, which has been already connected to the personal computer system, and a music passage is reproduced through the electronic musical instrument on the basis of the MIDI music data codes stored in the standard MIDI file. Users, who hesitate as to whether or not they will purchase pieces of music, appreciate such a music data allotting service, because they can determine it through the audition.

However, if the users can repeatedly reproduce the pieces of music, they may determine not to purchase the pieces of music, because they think it possible to store the standard MIDI file in a memory space. The standard MIDI file may be illegally duplicated. Such an unapproved duplication is violence against the copyright law.

In order to make the duplication difficult, a data conversion technique is disclosed in Japanese Patent Application laid-open No. Hei 10-124046. The prior art data converter disclosed in the Japanese Patent Application laid-open is hereinafter referred to as "first prior art".

The first prior art data converter is incorporated an external memory unit to be connected to plural electronic musical instruments, and is operative to convert music data codes formatted for a data transmission to music data codes formatted for a particular model of an electronic musical instrument. The music data codes formatted for the particular model is economical from the viewpoint of the consumed memory locations. The music data codes for the data transmission are temporarily stored in the first prior art data converter. The discriminative code representative of the particular model is assumed to have been already recorded. Upon reception of the music data codes, the first prior art data converter specifies the model assigned to the data source, converts the received music data codes to the corresponding music data codes formatted for the particular model, and stores the corresponding music data codes in the data storage.

Another prior art data converter is disclosed in Japanese Patent Application laid-open No. Hei 10-124046, which is corresponding to Japanese Patent Application No. 9-222531. The applicant filed Japanese Patent Application No. 9-222531 on the basis of Japanese Patent Application No. Hei 8-228843 under claiming the domestic priority right. The applicant further filed U.S. Pat. No. 6,034,314 on the basis of Japanese Patent Application No. Hei 8-228843 under claiming the convention priority right. The prior art data converter disclosed in the Japanese Patent Application laid-open is hereinafter referred to as "second prior art".

The second prior art data conversion system disclosed therein is used in the data conversion between music data codes defined in the GS standard and music data codes formatted in the XG standard. Both GS and XG standards are defined in conformity with the GM standard in the MIDI standard. Although a substantial part of the rules are common between the GS standard and the XG standard, there are several differences between the GS standard and the XG standard. For example, some tone color numbers, several sorts of effects and effect parameters are different between the GS standard and the XG standard. A user is assumed to wish to reproduce a piece of music on the basis of a set of music data codes formatted in the GS standard through an electronic musical instrument designed for the music data codes formatted in the XG standard. The second data converter fetches the music data codes formatted in the GS standard, and converts the music data codes representative of the tone color, effects and other differences to the corresponding music data codes so that the piece of music is exactly reproduced through the electronic musical instrument.

A problem is encountered in that the user can duplicate the received music data codes, because the format for them is common to the electronic musical instruments. Moreover, the first prior art data converter is bulky and complicated, because the first prior art data converter is incorporated in the external memory unit.

A problem inherent in the second prior art data converter is that the data conversion between the GS standard and the XG standard is not effective against the illegal duplication, because the differences between the GS standard and the XG standard have been already known. Moreover, the differences are not substantial.

Yet another prior art, which the applicant paid the attention, is disclosed in Japanese Patent Application laid-open No. Sho 63-301997. The prior art disclosed in the Japanese Patent Application laid-open relates to the data transmission of the MIDI music data codes in the form of packets. When each packet is filled with the MIDI data codes, or when a predetermined time interval is expired, the packet is delivered to the communication network. However, any format change is not carried out.

SUMMARY OF THE INVENTION

It is therefore an important object of the present invention to provide a music system, which produces music sound on the basis of music data effective against illegal duplication.

It is also an important object of the present invention to provide a music data source, which prepare supplies pieces of music data effective against illegal duplication to users.

It is another an important object of the present invention to provide a music producer, which produce music sound on the basis of the pieces of music data restored from the pieces of music data supplied from the music data source.

In accordance with one aspect of the present invention, there is provided a music system for producing music sound on the basis of pieces of regular music data comprising a music data source enciphering the pieces of regular music data to pieces of enciphered music data and memorizing the pieces of enciphered music data in a data field of a format for producing at least one message, a music producer restoring the pieces of enciphered music data in the message to the pieces of regular music data and producing the music sound on the basis of the pieces of regular music data, and a data transporter for transporting the at least one message from the music data source to the music producer.

In accordance with another aspect of the present invention, there is provided a music data source for producing at least one message representative of music sound comprising a data storage having addressable memory locations where at least plural sets of pieces of regular music data are stored, a data processing unit connected to the data storage, selectively reading out the plural sets of pieces of regular music data, enciphering the set of pieces of regular music data to a set of pieces of enciphered music data and memorizing the set of pieces of enciphered music data in a data field of a format for producing the at least one message, and a delivery port receiving the at least one message from the data processing unit and delivering the at least one message to a data transporter.

In accordance with yet another aspect of the present invention, there is provided a music producer for producing music sound on the basis of a set of pieces of regular music data comprising a reception port receiving at least one message formed in a format and having a set of pieces of enciphered music data in a data field of the format, a data processing unit connected to the reception port and restoring a set of pieces of enciphered music data taken out from the at least one message to the set of pieces of regular music data, and a music sound generator connected to the data processing unit and producing the music sound on the basis of the set of pieces of regular music data.

BRIEF DESCRIPTION OF THE DRAWINGS

The features and advantages of the music system, music data source and music producer will be more clearly understood from the following description taken in conjunction with the accompanying drawings, in which.

DESCRIPTION OF THE PREFERRED EMBODIMENTS

Figure 1:
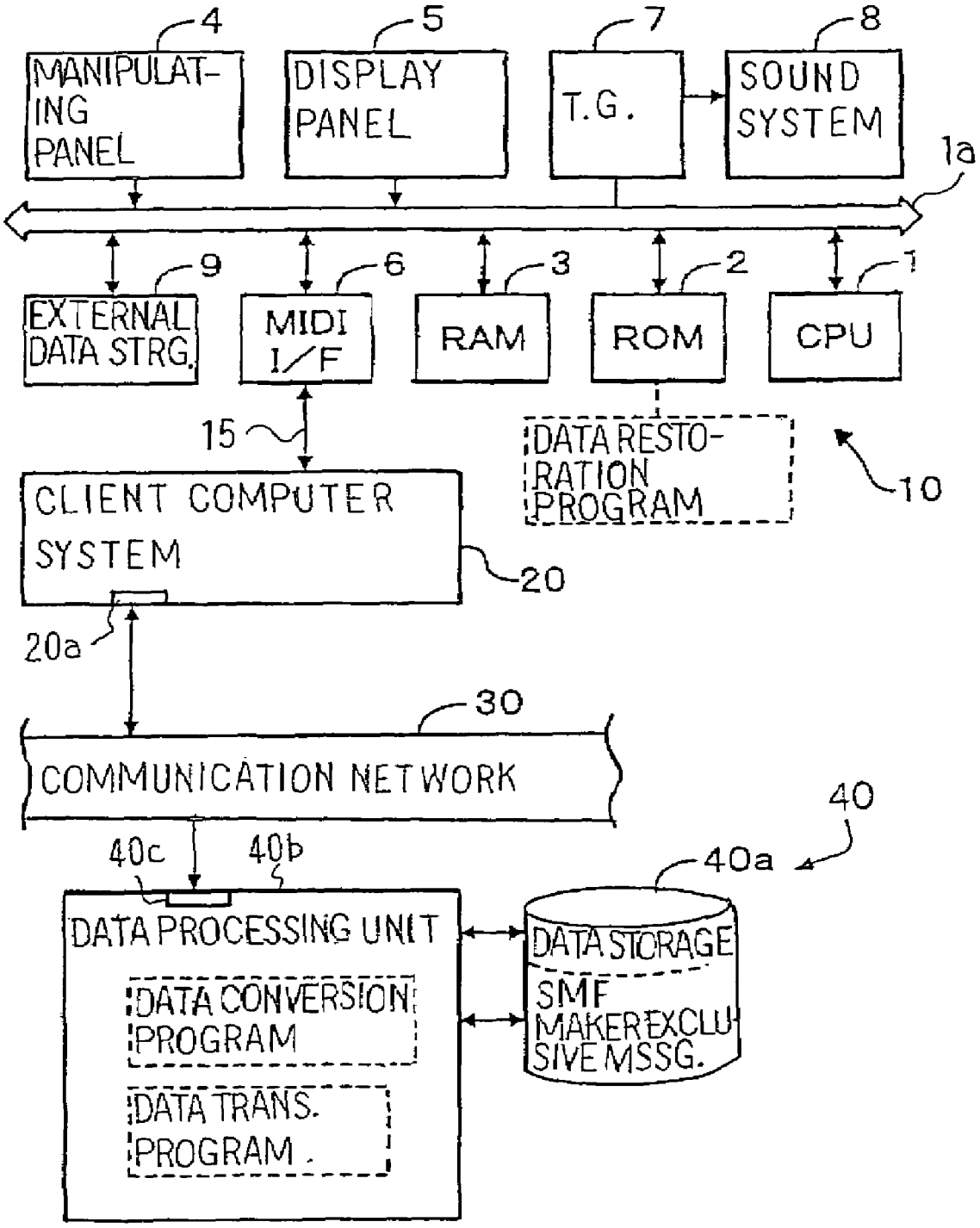
FIG. 1 is a block diagram showing the system configuration of a music system according to the present invention.

Description is firstly made on the MIDI messages. The MIDI messages are firstly broken down into channel messages and system messages. The channel messages are further broken down into voice messages and mode messages, and the music data representative of a performance, that is, the note-on, note-off, effects and so forth are given to electronic musical instruments through the voice messages. These are fixed-length data, and are well known to the persons skilled in the art. For this reason, no further description is hereinafter incorporated for the sake of simplicity.

The system messages are used for controlling music systems. System exclusive messages are typical examples of the system messages. The system exclusive messages are broken down into maker exclusive messages and universal exclusive messages. The maker exclusive messages are of a full-custom-made. However, the universal exclusive messages are a sort of semi-custom made message.

The maker exclusive messages are given to the music systems in the form of variable-length data. According to the MIDI standard, the format for the maker exclusive messages has six fields. The first field is assigned to a status byte "F0(H)" or "F0h" representative of the head of the system exclusive message. The large alphabet "H" in the parentheses or the small alphabet "h" means that the character or characters in front of the parentheses or the small alphabet "h" represent the hexadecimal number. The second field is assigned to an ID code representative of the hardware makers. The ID code representative of the hardware makers is hereinafter referred to as "maker ID code". A device ID code follows, and is assigned the third field. The device ID is representative of a model of the instrument. The fifth field is assigned to a checksum, and the sixth field is assigned to another status byte "F7(H)" or "F7h" representative of the end of the system exclusive message. The fourth field is assigned to variable-length data. The amount of data to be transferred is not restricted. Nevertheless, a large amount of data may be divided into plural sub-data, which are respectively loaded into plural maker exclusive messages. This means that the real time messages may intervene between the plural system exclusive messages. The MIDI standard permits the hardware maker to freely design the data in the fourth field of the maker exclusive messages. Thus, the maker exclusive messages are flexible, and are available for the music system according to the present invention.

In the following description, term "MIDI music data" means data defined in the MIDI standards. The "channel message", "system exclusive message" and "maker exclusive message" have been already described. Term "event data" means a piece of the MIDI music data required for a tone to be produced. The note-on event and note-off event are typical examples of the event represented by the event data. A piece of note-on event data contains a status byte representative of the note-on and other pieces of information to be required for producing a tone. Term "delta time" is a time interval between the events, which are sequentially to take place, and is represented by "delta time data". The delta time is expressed as a number of tempo clocks.

The system exclusive messages are usually addressed to predetermined musical instruments in a music system. Important control data such as, for example, tone color parameters are, by way of example, written in the fourth field of the maker exclusive message, and the maker exclusive message is supplied to the predetermined musical instruments. The system exclusive messages have serious influences on the musical instruments. For this reason, the usage of the system exclusive messages is rare in standard music systems.

In a music system according to the present invention, the channel messages such as the event data and delta time data are firstly enciphered, and the enciphered music data are put in the fourth field of the maker exclusive message. The maker exclusive message is loaded into a packet or packets, and the packets are transported to a musical instrument or instruments, which form a part or parts of the music system through a communication network. Upon reception, the enciphered music data are taken out from the maker exclusive message, and are cryptanalyzed to the channel messages. The musical instrument is responsive to the voice messages representative of the piece of music so as to produce tones on the basis of the voice messages. Although the maker exclusive message contains the voice messages, the event data and time data are enciphered so that the piece of music is not reproduced through other sorts of musical instruments, which the maker exclusive message is not addressed to.

Music System

Referring to FIG. 1 of the drawings, a music system embodying the present invention largely comprises an electronic musical instrument 10, a client computer system 20, a communication network 30 and a server computer system 40. The electronic musical instrument 10 is connected to the client computer system 20 through a MIDI cable 15, and maker exclusive messages are, by way of example, transferred from the client computer system 20 to the electronic musical instrument through the MIDI cable 15. The client computer system 20 and server computer system 40 are connected to the communication network 30 so that the client computer system 20 and server computer system 40 communicate with one another through the communication network 30. The communication network 30 may connect internet service providers. In this instance, the maker exclusive messages are transported from the server computer system 40 through the internet to the client computer system 20.

When a user, who is assumed to dominate the client computer system 20, wishes an audition, he or she instructs the client computer system 10 to request the server computer system 40 to send the MIDI music data representative of the piece of music thereto through the communication network 30. When the request reaches the server computer system 40, the server computer system 40 loads a maker exclusive message, in which enciphered music data have been already written, into a packet or packets, and transmits the packet or packets to the client computer system 20 through the communication network 30.

Channel messages representative of the piece of music may be enciphered so as to prepare the maker exclusive message after the reception of the request. Otherwise, the server computer system 40 may access a database where the maker exclusive message has been already stored together with other maker exclusive messages for other pieces of music.

When the packet or packets reach the client computer system 10, the client computer system 10 transfers the packet or packets to the electronic musical instrument 10. The electronic musical instrument 10 restores the payload of the packet or packets to the maker exclusive message, and takes out the channel messages representative of the piece of music from the enciphered music data through the cryptanalysis. The electronic musical instrument produces the tones along the music passage on the basis of the channel messages.

Those system components 10, 20 and 40 are hereinafter described in more detail.

Electronic Musical Instrument

The electronic musical instrument 10 includes a central processing unit 1, which is abbreviated as "CPU", a read only memory 2, which is abbreviated as "ROM", a random access memory 3, which is abbreviated as "RAM", a manipulating panel 4, a display panel 5, a MIDI interface 6, which is abbreviated as "MIDI I/F", a tone generator 7, which is abbreviated as "T.G.", a sound system 8 and an external data storage 9. In this instance, the central processing unit 1 is implemented by a microprocessor, and an electrically erasable and programmable memory is used as the read only memory 2. The central processing unit 1, read only memory 2, random access memory 3, manipulating panel 4, display panel 5, MIDI interface 6, tone generator 7 and external data storage 9 are connected to a shared bus la so that the central processing unit 1 is communicable with the other components 2-7 and 9 through the shared bus 1*a*. The MIDI interface 6 is connected through the MIDI cable 15 to a suitable data port of the client computer system 20, and a message representative of the request for allotting a maker exclusive message and packets are transferred through the MIDI interface 6 between the central processing unit 1 and the client computer system 20.

Computer programs and data tables are stored in the read only memory 2. One of the computer programs is a main routine program, and the main routine program conditionally branches into other computer programs. Another computer program is hereinafter referred to as "data restoration program". The data restoration program expresses a method for restoring packets to the channel messages representative of a piece of music, and will be hereinlater described in detail.

While the electronic musical instrument 10 is standing idle, the central processing unit 1 reiterates the main routine program, and waits for user's instruction or arrival of packets. When the user's instruction is given to the electronic musical instrument, or when a packet reaches the MIDI interface, the main routine program selectively branches into the other computer programs, and achieves the task given by the user. The random access memory 3 offers a temporary data storage to the central processing unit 1.

Plural keys, switches and levers are arrayed on the manipulating panel 4, and make a switch circuit selectively turn on and off. The central processing unit 1 periodically checks the switch circuit in the execution along the main routine program to see whether or not a user manipulates any one of the keys, switches and levers. When the central processing unit 1 acknowledges the manipulation, the central processing unit 1 specifies the task to be achieved, and runs on the computer program representative of a method for achieving the task.

The display panel 5 includes a display driver. When the central processing unit 1 supplies pieces of image data to the display driver, the display driver produces visual images on the screen of the display panel 5.

The tone generator 7 offers plural tone generation channels to the voice messages representative of the note-on events, note-off events, velocity and effects in a time sharing multiplication manner, and produces a digital audio signal from pieces of waveform data. The tone generator 7 is connected to the sound system 8 so that the digital audio signal is supplied to the sound system 8. The digital audio signal is converted to an analog audio signal, and electronic tones and/or rhythm sound are produced from the analog audio signal through loud speakers and/or a headphone.

A hard disk driver, floppy disk (which is a trademark) driver, a CD-ROM driver, a magneto-optical disk driver or a digital versatile disk driver serves as the external data storage 9. Of course, more than one disk driver may serve as the external data storage. The central processing unit 1 stores a standard MIDI file in the external data storage 9, by way of example. The computer program such as the data restoration program may be transferred from the external data storage to the read only memory 2 for version-up.

While the user is fingering on the plural keys, the central processing unit 1 specifies the depressed keys and released keys, and supplies the voice messages representative of the note-on event, note-off event and effects to be imparted to the tones to the tone generator 7. The digital audio signal is produced from the pieces of waveform data, and is supplied to the sound system 8 so that the electronic tones are radiated from the loud speakers.

On the other hand, when a packet or packets reach the MIDI interface 6, the main routine program branches the data restoration program, and the central processing unit 1 starts to run thereon. Channel messages representative of a piece of music are taken out from a maker exclusive message, to which the payload of the packet or packets has been restored. The central processing unit 1 transfers the channel messages representative of the piece of music to the tone generator 7, and the tone generator 7 produces the digital audio signal from the pieces of waveform data on the basis of the channel messages. The digital audio signal is supplied to the sound system 8, and the electronic tones are successively produced through the sound system 8. Thus, the user listens to the piece of music for the audition. The data restoration program will be hereinlater described in more detail.

Client Computer System

The client computer system 20 includes a data processor, a program memory, a working memory, a keyboard, a display unit and a data circuit terminal equipment 20*a* such as, for example, a modem or a digital service unit. A suitable communication program, which is hereinafter referred to as "audition program", is stored in the program memory together with other computer programs. When a user instructs the client computer system 20 to request the server computer system 40 to send channel messages representative of a piece of music thereto, the data processor starts to run on the audition program, and firstly prompts the user to input the title of a piece of music requested for the audition through the display unit. The user inputs the title of the piece of music through the keyboard. Then, the data processor prepares a packet. The request for audition, title of the piece of music and address assigned to the user are loaded into the packet together with other pieces of information. Upon completion of the loading, the data processor sends the packet from the data circuit terminal equipment 20*a* through the communication network 30 to the server computer system 40.

While the server computer system 40 is sending a packet or packets in which enciphered music data representative of a maker exclusive message is loaded, the client computer system 20 receives the packet or packets at the data circuit terminal equipment 20*a*, and the data processor transfers the packet or packets through the MIDI cable 15 to the MIDI interface 6.

Server Computer System

The server computer system 40 includes a data storage 40*a*, a data processing unit 40*b* and a data circuit terminal equipment 40*c* such as, for example, a modem or a digital service unit. A data processor, a program memory, a working memory and other components are incorporated in the data processing unit 40*b*, and a main routine program, a data conversion program, a data transmission program and other computer programs are stored in the program memory. The data processor runs on the main routine program, and the main routine program selectively branches into the data conversion program, data transmission program and other computer programs. The data conversion program and data transmission program will be hereinlater described in more detail.

The data processing unit 40*b* is connected to the data storage 40*a*, and the data processor selectively accesses pieces of data stored in the data storage 40*a*. Plural standard MIDI files SMF for pieces of music and plural maker exclusive messages are stored in the data storage 40*a*. In this instance, channel messages representative of pieces of music were enciphered, the pieces of enciphered music data were memorized in the fourth field of the plural maker exclusive messages, and the plural maker exclusive messages have been already loaded into packets. The data processor achieved these jobs through execution of the data conversion program. For this reason, the data processor selectively reads out the packets from the data storage 40*a* upon reception of user's requests, and delivers the packets to the data circuit terminal equipment 40*c*.

Data Conversion Program

Figure 2:
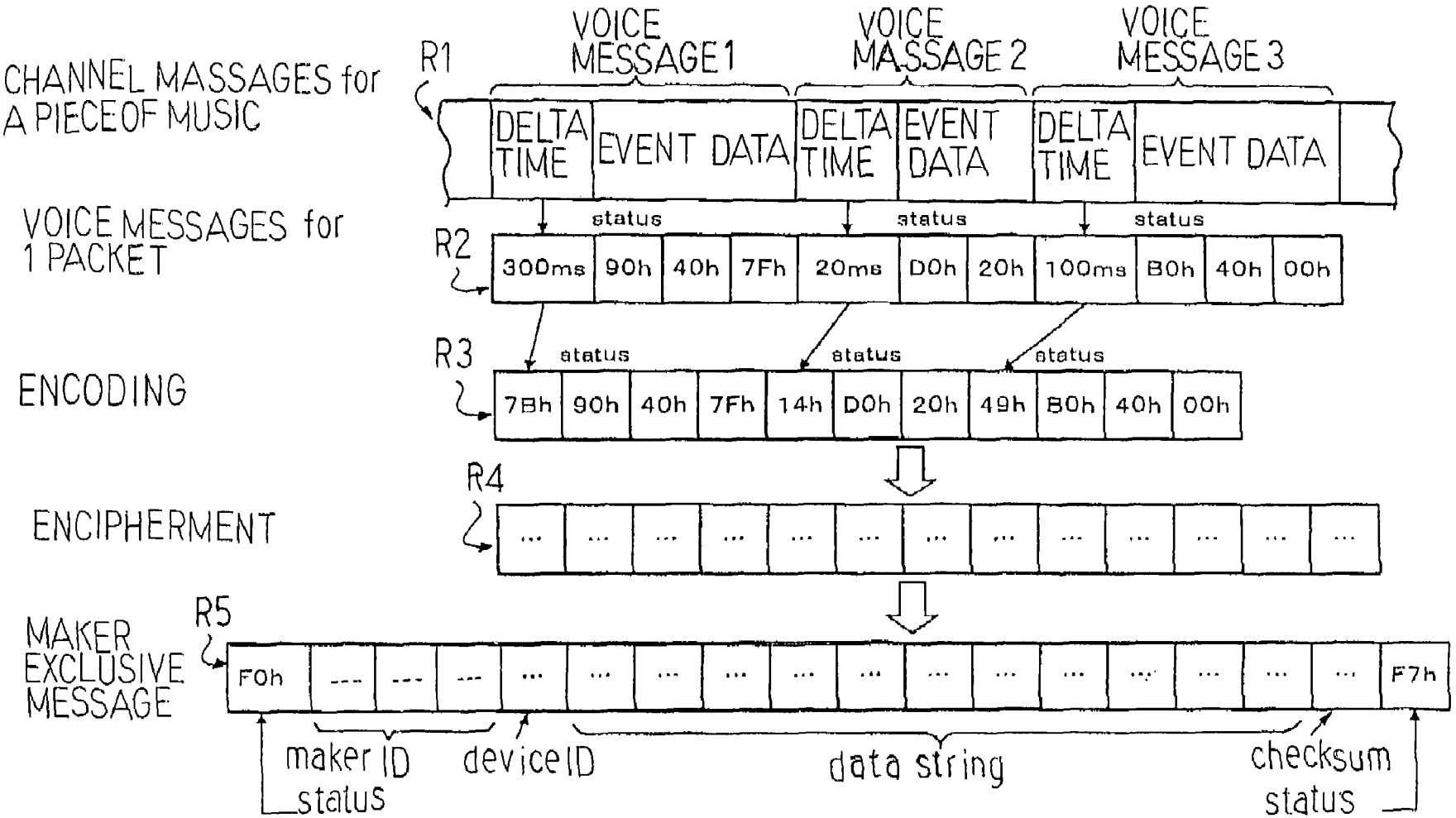
FIG. 2 is a view showing a data conversion from channel messages to a maker exclusive message.

Turning to FIG. 2 of the drawings, channel messages for a piece of music are stepwise converted to a maker exclusive message. A set of channel messages for a piece of music contains plural voice messages, and each voice message contains a piece of delta time data and a piece of event data.

Figure 3:
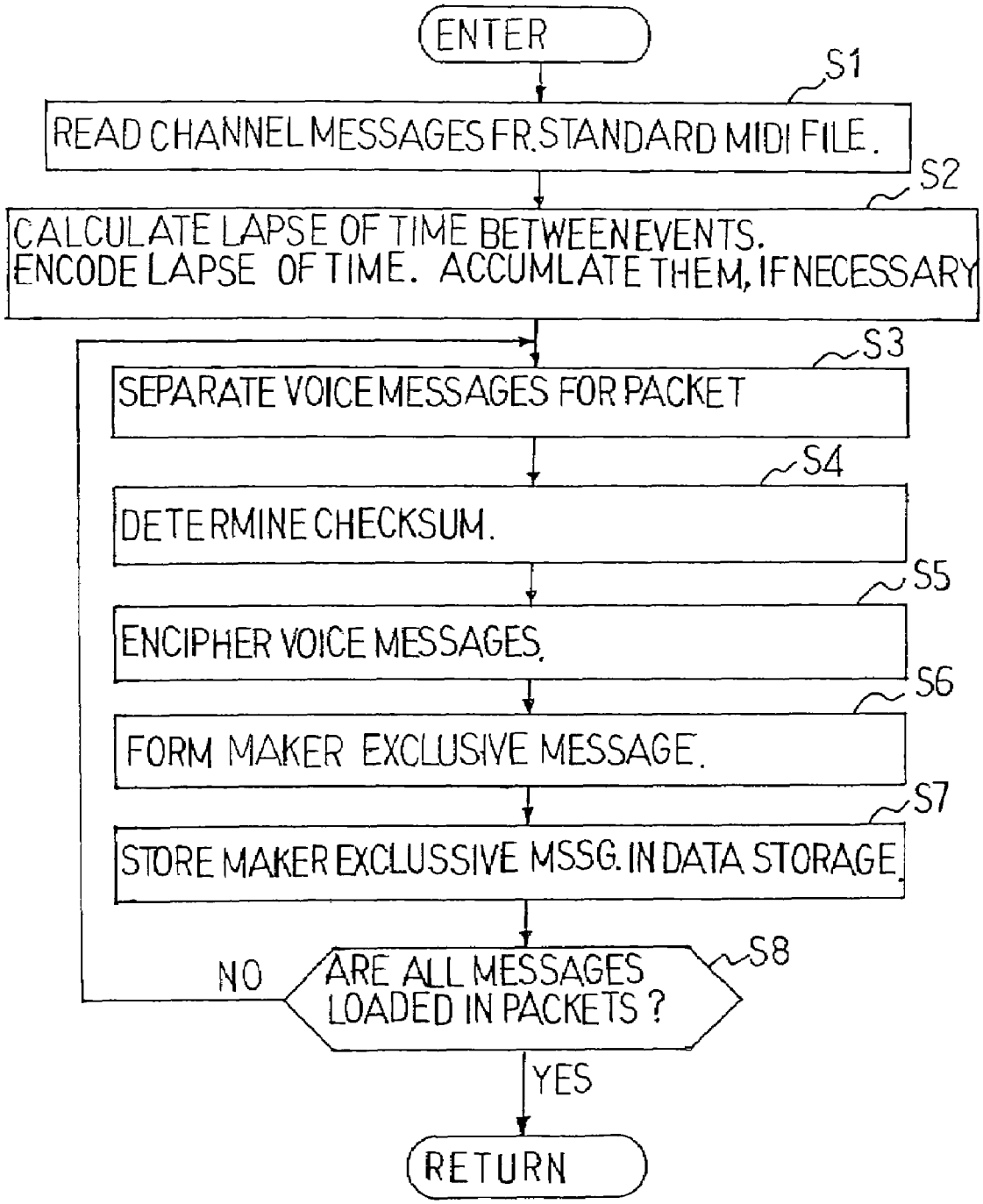
FIG. 3 is a flowchart showing a job sequence achieved through the execution of a data conversion program.

Description is hereinafter made on the data conversion program with concurrent reference to FIGS. 2 and 3. When the main routine program branches into the data conversion program, the data processor transfers a MIDI standard file, in which a piece of music has been recorded, from the data storage 40*a* to the working memory, and reads out the channel messages from the standard MIDI file as by step S1. The voice messages, which are a sort of channel messages, are representative of pieces of event data, and the pieces of event data are respectively accompanied with pieces of the delta time data as indicated by R1.

Subsequently, the data processor calculates the lapse of time between each piece of event data and the next piece of event data on the basis of the pieces of delta time data as by step S2. The lapse of time is given as the product between the number of the tempo clocks and the pulse period of the tempo clock signal so that the data processor multiples the piece of delta time data by the value equal to the pulse period. The lapse of time is expressed in millisecond. The lapse of time is rounded to a 7-bit hexadecimal number, and zero is given to the most significant bit. Thus, a byte is assigned to the lapse of time.

Figure 4:
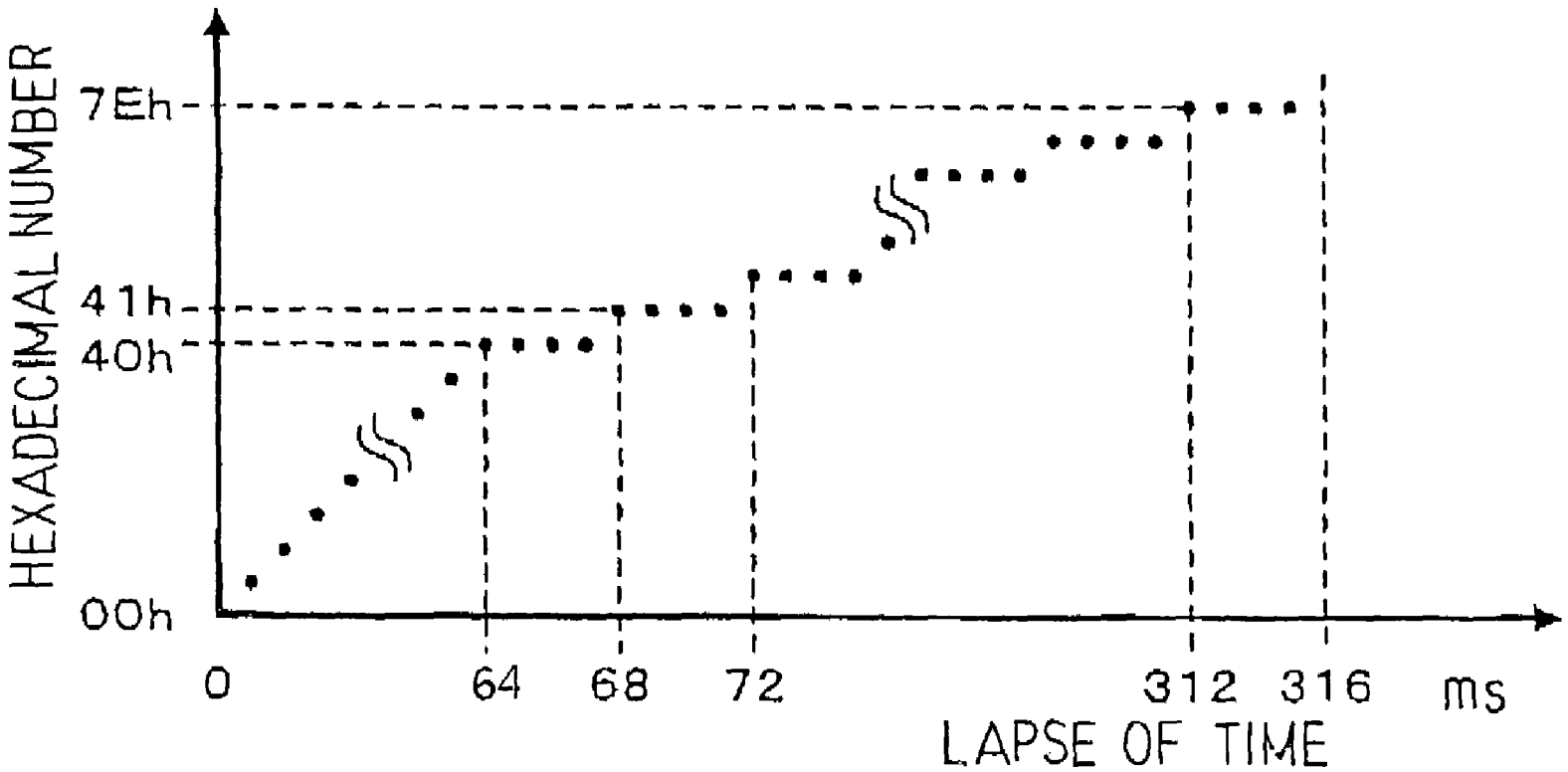
FIG. 4 is a graph showing a relation between a lapse of time and corresponding hexadecimal numbers.

However, the 7-bit hexadecimal number is too short to express the lapse of time. In order to express the lapse of time as the 7-bit code, the lapse of time is encoded as shown in FIG. 4. While the lapse of time is being incremented from zero to 63 milliseconds, the hexadecimal number is also incremented by one. When the lapse of time exceeds 63 milliseconds, the hexadecimal value of "1" is equivalent to four milliseconds. For example, if the lapse of time is fallen within the range between 64 milliseconds to 67 milliseconds, the lapse of time is expressed as hexadecimal number "40h". The lapse of time between 68 milliseconds and 71 milliseconds is made equivalent to hexadecimal number "41h". The lapse of time between 312 milliseconds and 315 milliseconds is equivalent to hexadecimal number "7Eh". However, if the lapse of time is equal to or greater than the 316 milliseconds, the lapse of time is expressed as "7Fh", and the previous values of the lapse of time are accumulated so that a lapse of time from the first event to the associated event is determined for the associated piece of event data.

Although the hexadecimal number between "00h" and "63h" is equivalent to the lapse of time between zero to 63 milliseconds, the hexadecimal number between "40h" and "7Eh" is not exactly corresponding to the lapse of time between 64 milliseconds and 315 milliseconds. However, it is rare for the listeners to notice the difference. For this reason, the data processor compresses the lapse of time, and encodes it as the 7-bit hexadecimal number. The lapse of time greater than 316 milliseconds is replaced with the lapse of time from the first event to the associated event, which is exactly corresponding to the hexadecimal number. In order to discriminate the lapse of time between the events from the lapse of time from the head event to the associated event, the lapse of time between the events is referred to as "short-term lapse of time", and the lapse of time from the head event to the associated event is referred to as "long-term lapse of time". The long-term lapse of time is memorized in the working memory in association with the piece of event data accompanied with the hexadecimal number "7Fh". The hexadecimal number "7Fh"

means that the associated piece of event data is accompanied with the long-term lapse of time, and is hereinafter referred to as "quasi-lapse of time".

The voice messages 1, 2, 3 are assumed to have the pieces of delta time data equivalent to 300 milliseconds, 20 milliseconds and 100 milliseconds, respectively. These values of the short-term lapse of time are encoded as "7Bh", "14h" and "49h", respectively, as shown in the second row R2 and third row R3 in FIG. 2.

Upon completion of the encoding, the data processor separate a group of the voice messages from the voice messages R1 as by step S3. The maximum number of the bytes assigned to the group of the voice messages is equal to the difference between the amount of payload of a packet and the bytes required for the status byte representative of the header, maker ID, device ID, checksum and status byte representative of the footer. However, if the data processor finds a voice message, which contains the hexadecimal number representative of the quasi-lapse of time, i.e., "7Fh", the data processor groups the previous voice messages before the voice message for the packet, and puts the voice message with the quasi-lapse of time, at the head of the payload of the next packet.

Subsequently, the data processor determines the checksum, and memorizes the checksum in the working memory as by step S4. Various calculation methods have been known to the skilled persons in the art so that no further description is incorporated for the sake of simplicity.

Subsequently, the data processor enciphers the voice messages, that is, the pieces of delta time data already encoded as the hexadecimal numbers and pieces of event data as by step S5. Any cryptographic technique is available for the voice messages. The pieces of delta time data already encoded as the hexadecimal numbers and pieces of event data are converted to pieces of enciphered music data through the encipherment as indicated by R4.

Subsequently, the data processor forms a maker exclusive message as by step S6. In detail, the status byte of "F0h", maker ID code and device ID code are respectively memorized in the first, second and third fields, and the enciphered music data are written in the fourth field. Finally, the checksum and status byte of "F7h" are memorized in the fifth and sixth fields. Then, the maker exclusive message is completed as indicated by R4.

Subsequently, the maker exclusive message and long-term lapse of time, if any, are transferred to the data storage 40*a*, and are stored therein as by step S7. In the data transmission, which will be described hereinafter, when the data processor finds the quasi-lapse of time at the head of the payload, the data processor checks the long-term lapse of time for the packet, and determines the time to deliver the packet to the data circuit terminal equipment 40*c*. Upon completion of the write-in, the data processor checks the working memory to see whether or not all the voice messages have been already loaded in the packets as by step S8. If there remain other voice messages, the answer at step S8 is given negative, and the data processor returns to step S3. Thus, the data processor reiterates the loop consisting of steps S3 to S7 until the answer at step S8 is changed to affirmative. When the last maker exclusive message, in which the last voice message was loaded, is stored in the data storage 40*a*, the answer at step S8 is given affirmative, and the data processor returns to the main routine program.

As will be understood from the foregoing description, the voice messages are enciphered to the pieces of enciphered music data, which are memorized in the fourth field of the maker exclusive messages, and the maker exclusive messages are loaded into the packet or packets. Even if maker exclusive messages are duplicated, it is impossible to recover the enciphered music data to the voice messages. Thus, only the user, who has the right to produce the music, can listen to the piece of music for the audition.

Data Transmission Program

Figure 5:
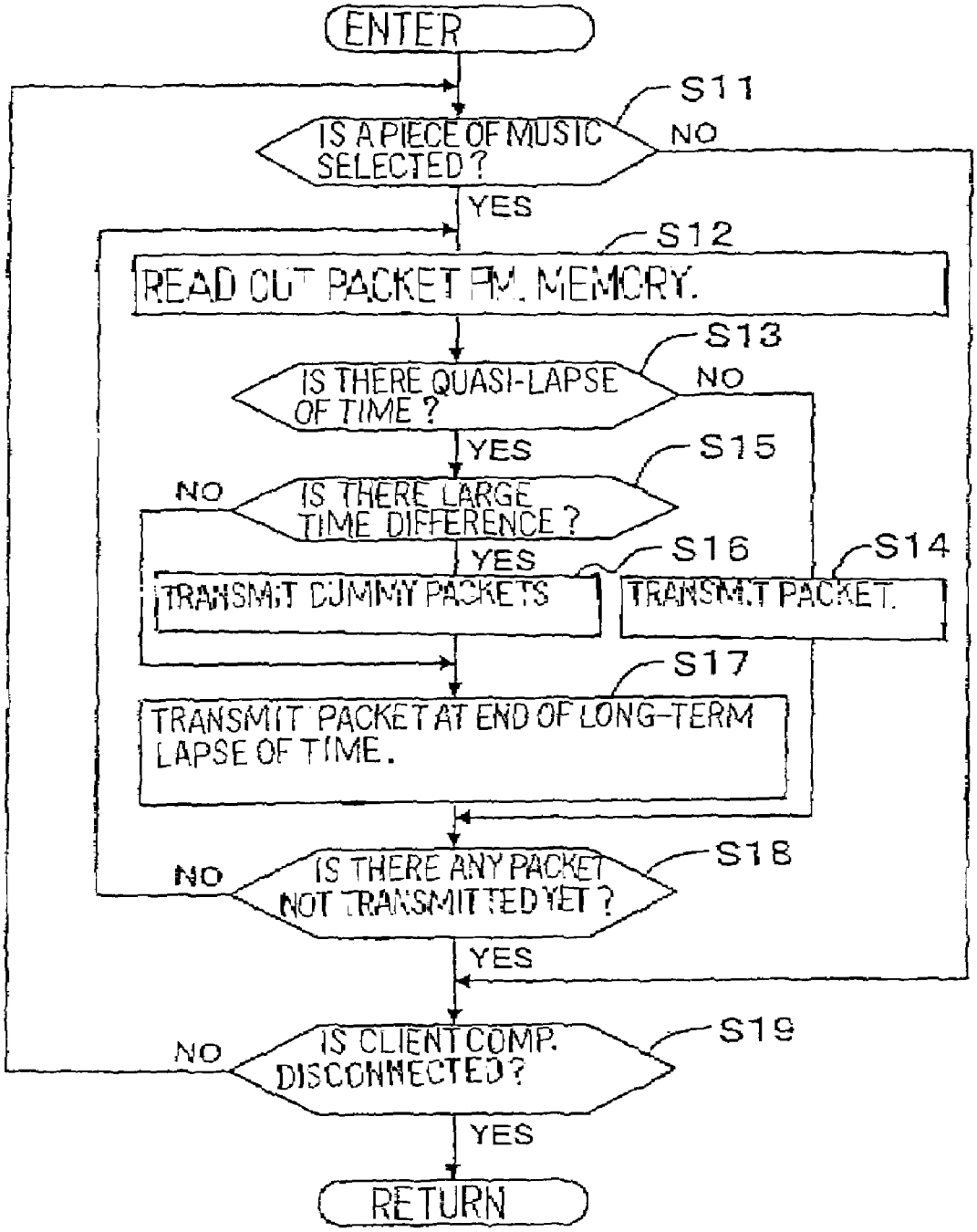
FIG. 5 is a flowchart showing a job sequence achieved through the execution of a data transmission program.

FIG. 5 shows a job sequence in the data transmission program. When the request for allotment reaches the server computer system 40, the data processor enters the data transmission program. The data processor checks the packets, which have already reached the server computer system 40, to see whether or not the user designates a piece of music as by step S11.

If the user has not selected any piece of music, yet, the answer at step S11 is given negative, and the data processor proceeds to step S19. The data processor checks the data circuit terminal equipment 40*c* to see whether or not the client computer system 20 is disconnected from the communication network 30. When the answer at step S19 is given negative, the data processor return to step S11, and reiterates the loop consisting of steps S11 and S19 until the answer at either step S11 or S19 is changed to affirmative.

On the other hand, when a packet, in which a designated piece of music has been already loaded, reaches the data circuit terminal equipment 40*c*, the answer at step S11 is given affirmative, and the data processor transfers the packets, in which the maker exclusive messages have been already loaded, and the associated long-term lapse of time from the data storage 40*a* to the working memory. Upon completion of the data transmission, the data processor reads out the packet at the head of the queue as by step S12.

Subsequently, the data processor checks the packet at the head of the queue to see whether or not the quasi-lapse of time "7Fh" is placed at the head of the payload as by step S13. The short-term lapse of time is to be found in the payload of the first packet, and the data processor starts an internal timer so as to measure a lapse of time for reference. When the short-term lapse of time is found, the answer at step S13 is given negative, and the data processor delivers the packet to the data circuit terminal equipment 40*c* so that the packet is transmitted through the communication network 30 to the client computer system 20.

On the other hand, when the data processor finds the quasi-lapse of time at the head of the payload, the answer at step S13 is given affirmative, and the data processor reads out the long-term lapse of time associated with the packet. Then, the data processor compares the long-term lapse of time with the internal timer to see whether or not the time difference is longer than a predetermined value as by step S15.

If the internal timer is indicative of a time well before the end of the long-term lapse of time, the answer at step S15 is given affirmative, and determines how many dummy packets are to be transmitted. When the number of dummy packets to be transmitted before the end of the long-term lapse of time, the data processor delivers the dummy packets to the data circuit terminal equipment 40*c*, and the dummy packets are transmitted through the communication network as by step S16. A certain maker exclusive message is loaded into the dummy packet. Although the dummy packet has the status bytes, maker ID and device ID same as those of the regular packets, an erroneous checksum is intentionally written in the fifth field of the dummy packet. For this reason, the electronic musical instrument ignores the dummy packets, and any tone is not produced on the basis of the dummy packets. The transmission of the dummy packets is desirable, because the stream of the dummy packets keeps the communication between the server computer system 40 and the client computer system 20 stable.

Upon completion of the transmission of the dummy packets, the time to transmit the packet comes so that the data processor delivers the packet to the data circuit terminal equipment 40*c*, and the packet is transmitted through the network 30 to the client computer system 20 as by step S17.

Upon completion of the transmission procedure at S14 or S17, the data processor checks the working memory to see whether or not there remains a packet not transmitted yet as by step S18. If the data processor finds a packet, which has not been transmitted yet, the data processor returns to step S12, and reads out the next packet. Thus, the data processor reiterates the loop consisting of steps S12 to S18, and delivers the packet to the data circuit terminal equipment 40*c*.

When the last packet is transmitted at step S17, the answer at step S18 is given affirmative, and the data processor proceeds to step S19. While the client computer system 20 is connecting through the communication network 30 to the server computer 40, the answer at step S19 is given negative, and the data processor returns to step S11. If the client computer system 20 transmits a packet where a new piece of music has bee already designated, the data processor repeats steps S12 to S18 so that the maker exclusive messages are carried to the client computer system 20. On the other hand, when the client computer system 20 terminates the communication at the previous packet, the answer at step S19 is given affirmative, and the data processor returns to the main routine program.

As will be understood, the maker exclusive messages are transferred through the communication network 30 to the client computer system 20 in the real time fashion, and the client computer system 20 supplies the packets to the electronic musical instrument 10. The central processing unit 1 runs on the data restoration program so as to restore the payloads to the channel messages representative of the piece of music as will be hereinafter described in detail.

Data Restoration Program

Figure 6:
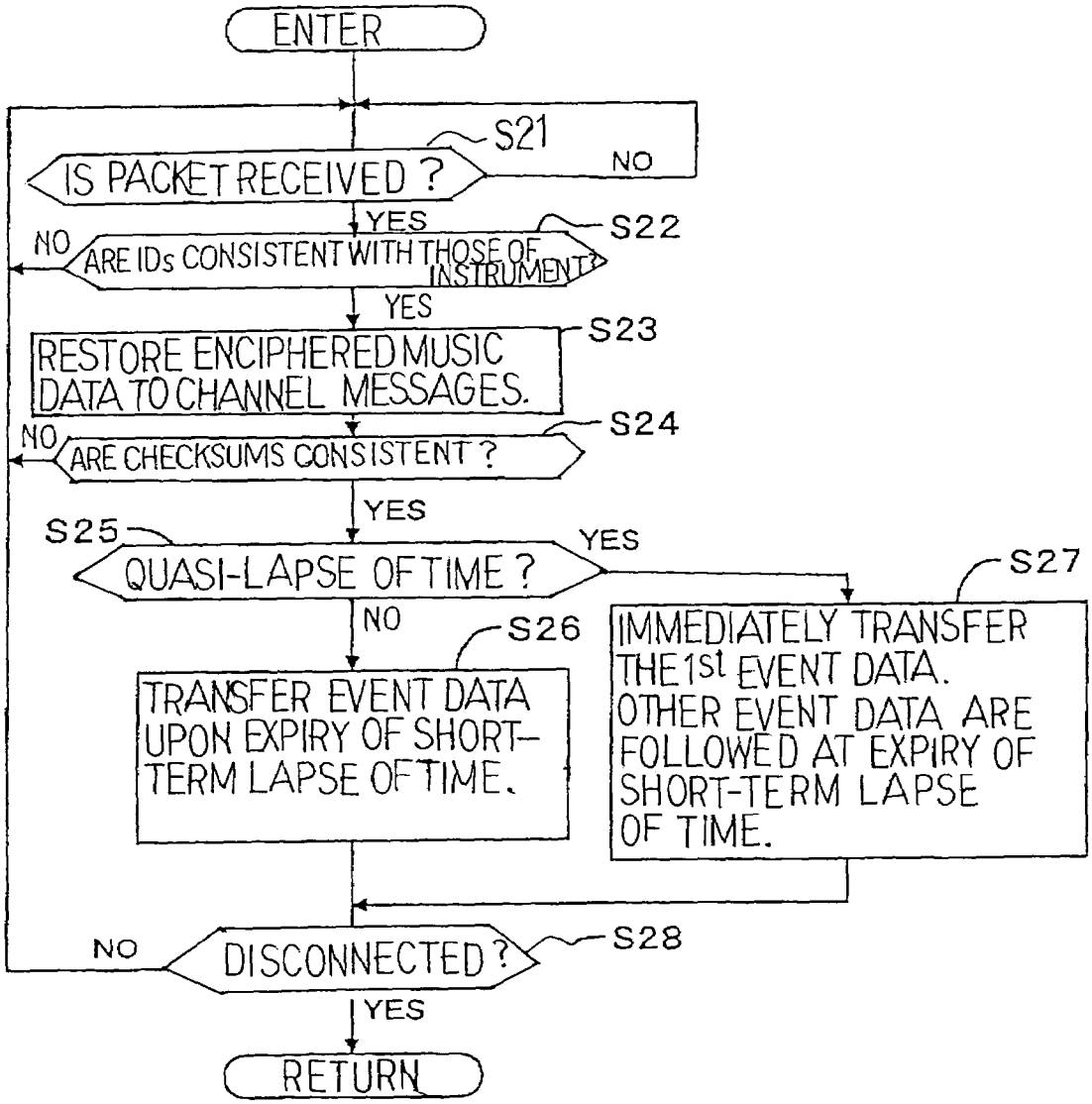
FIG. 6 is a flowchart showing a job sequence achieved through the execution of a data restoration program.

FIG. 6 shows a job sequence of the data restoration program. As described hereinbefore, the user instructs the client computer system 20 to request the server computer system 40 to transmit the maker exclusive messages representative of a piece of music for audition. The user's request makes the main routine program branch to the data restoration program, and the central processing unit checks the MIDI interface 6 to see whether or not a packet reaches there as by step S21. If any packet has not arrived at the MIDI interface 6, the answer at step S21 is given negative, and the central processing unit 1 periodically checks the MIDI interface 6 for the packet.

When the first packet reaches the MIDI interface 6, the central processing unit 1 reads out the maker ID and device ID from the payload, and compares the maker ID and device ID with those stored in the read only memory 2 to see whether or not the maker ID and device ID are consistent with those of the electronic musical instrument 10 as by step S22. If the packet is addressed to another electronic musical instrument, the answer at step S22 is given negative, and the central processing unit 1 returns to step S21. Thus, the central processing unit 1 reiterates the loop consisting of steps S21 and S22.

If the packet is addressed to the electronic musical instrument 10, the maker ID and device ID are consistent with those stored in the electronic musical instrument 10, and the central processing unit 1 restores the enciphered music data to the channel messages representative of the piece of music as by step S23. The restoration method is reverse to the jobs at steps S4 to S6. In detail, the maker exclusive message is unloaded from the packet, and the status bytes, maker ID and device ID are removed from the maker exclusive messages. Subsequently, the pieces of the enciphered music data are converted to the pieces of event data and associated pieces of encoded delta time data. Finally, the pieces of encoded delta time data are decoded to the pieces of delta time data. As described hereinbefore, if the time interval is fallen within the range between 64 milliseconds and 315 milliseconds, every 4 milliseconds is corresponding to one of the hexadecimal numbers from "64h" to "7Eh". This means that the events take place at time the intervals, which are slightly different from those of the original performance. However, the difference is ignoreable in the audition.

Upon completion of the decoding, the central processing unit 1 calculates a checksum, and compares the checksum with the checksum stored in the fifth field to see whether or not all the bits in the fourth field are correctly received at the MIDI interface 6 as by step S24. If the checksums are different from each other, the received packet may be the dummy packet. Then, the central processing unit 1 returns to step S21, and waits for the next packet.

On the other hand, when the payload is the maker exclusive message for the piece of music, the checksums are consistent with one another, and the answer at step S24 is given affirmative. Then, the central processing unit 1 compares the piece of delta time data for the first piece of event data with the hexadecimal number "7Fh" to see whether or not the quasi-lapse of time occupies the head of the fourth field as by step S25.

If the short-term lapse of time occupies the head of the fourth field, the answer at step S25 is given negative, and the central processing unit 1 intermittently transfers the pieces of event data to the tone generator 7 upon expiry of the short-term lapse of time as by step S26.

On the other hand, when the quasi-lapse of time occupies the head of the fourth field, the central processing unit 1 immediately transfers the first piece of event data to the tone generator 7, and, thereafter, intermittently transfers the other pieces of event data to the tone generator upon expiry of the short-term lapse of time as by step S27. Because, the server computer system 40 transmitted the packet at the expiry of the long-term lapse of time. This means that the first piece of event data is delayed from the previous piece of event data, which was transmitted through the previous packet, by the time period approximately equal to the time interval represented by the original piece of delta time data. Thus, the voice messages are sequentially supplied to the tone generator 7 so that the electronic tones are produced along the music passage for the audition.

When the last piece of event data is supplied to the tone generator 7, the central processing unit 1 checks a flag representative of the communication status to see whether or not the client computer system 20 is disconnected from the communication network 30 as by step S28. If the client computer system 20 is still connected to the communication network 30, other packets will arrive at the MIDI interface 6. Then, the central processing unit 1 returns to step S21, and reiterates the loop consisting of steps S21 and S28.

When the client computer system 20 is disconnected from the communication network 30, any packet is no longer transmitted from the server computer 40. Then, the central processing unit 1 returns to the main routine program.

As will be understood, the enciphered music data are taken out from the maker exclusive messages, and, thereafter, are restored to the channel messages representative of the piece of music in the real time fashion. The piece of music is produced through only the electronic musical instrument, in which the data restoration program has been already installed. Even if the user memorizes the maker exclusive messages in the working memory of the client computer system, it is impossible to restore the enciphered music data to the voice messages, and the piece of music is not produced on the basis of the enciphered music data. Thus, the data transmission according to the present invention is effective against the illegal duplication.

Since the payloads are formatted in the maker exclusive message defined in the MIDI standard, any special hardware is not required for the data reception and cryptoanalysis, and the manufacturer can easily apply the present invention to his products.

Moreover, the packets are successively processed in the real time fashion so that any large memory is not required for the electronic musical instrument.

The dummy packets keep the communication between the server computer system 40 and the client computer system 20 stable.

The encoded delta time data is desirable from the viewpoint of a short data length. Similarly, the quasi-lapse of time with reference to the time data representative of the long-term lapse of time is desirable, because the small number of bits can represent the pieces of encoded delta time data.

Although particular embodiments of the present invention have been shown and described, it will be apparent to those skilled in the art that various changes and modifications may be made without departing from the spirit and scope of the present invention.

An electronic musical instrument may directly communicate with the server computer system 40 through a built-in transmitter. In this instance, a microprocessor, which serves as the central processing unit, may achieve all the jobs assigned to the client computer system 10 and electronic musical instrument 10.

Another sort of parity-check technique may be employed in the maker exclusive messages.

The cryptographic material may be transmitted from the server computer system 40 to the client computer system 20 as the payload of the packets. In this instance, plural sorts of cryptographic material have been prepared in the data storage 40*a*, and the server computer system 40 selectively transmits the plural sorts of cryptographic material to the client computer system prior to the transmission of the marker exclusive messages. The electronic musical instrument 10 restores the enciphered music data with reference to the cryptographic material.

A key data such as, for example, PGP may be used in the encipherment and cryptoanalysis. In this instance, the key data may be built-in both of the data processing unit 40*b* and electronic musical instrument 10. Otherwise, the key data are transmitted from the server computer system 40 to the client computer system 20 as the payload of the packets.

Although the pieces of music are stored in the data storage 40*a* in the form of the standard MIDI files, the standard MIDI file does not set any limit to the technical scope of the present invention. Another file format is available for the MIDI music data.

The MIDI standards do not set any limit to the technical scope of the present invention. Another sort of music data transmission standards or transmission protocols may be employed in a music system according to the present invention in so far as the pieces of music data are memorized in a data field of a format flexible to the designers. If the server computer system can designate the destination of the music data, the music data transmission standards are desirable.

The electronic musical instrument may measure a lapse of time from the reception of the last packet. In this instance, when a predetermined time period is expired without reception of any packet, the central processing unit 1 supplies the voice message representative of the note-off to the tone generator 7 so as to make all the tones decayed.

The client computer system 20 and electronic musical instrument 10 may be incorporated in a portable terminal such as, for example, a notebook-sized personal computer or a mobile telephone.

The packet communication does not set any limit to the technical scope of the present invention. The maker exclusive messages may be transmitted through an analog signal. In this instance, the data circuit terminal equipment would be replaced with modems. The maker exclusive messages, in which the pieces of enciphered music data are memorized, may be distributed through an information storage medium such as, for example, a compact disk.

The electronic tones do not set any limit to the technical scope of the present invention. Percussion sound may be produced on the basis of the channel messages. Moreover, the channel messages representative of the piece of music may be supplied to a hybrid musical instrument such as, for example, an automatic player piano or a mute piano.

The system components are correlated with claims languages as follows. The server computer system 40, client computer system/electronic musical instrument 20/10 and communication network 30 serve as a "music data source", a "music producer" and a "data transporter", respectively. The electronic tones are corresponding to "music sound". The channel messages, especially, voice messages serve as "pieces of regular music data", and the maker exclusive messages are corresponding to "at least one message".

The data circuit terminal equipment 40*c* and client computer system 20 serve as a "delivery port" and a "reception port", respectively. The central processing unit 1, read only memory 2, working memory 3 and MIDI interface 6 as a whole constitute a "data processing unit" of the music producer. The tone generator 7 and sound system 8 form in combination a "music sound generator". The lapse of time equivalent to "7Fh" is "critical time period".

What is claimed is:

1. A music system for producing music sound on the basis of pieces of regular music data stored in formats defined in MIDI protocols and expressing channel messages, comprising:

a music data source including an information processor having a first information processing capability and a program memory where a series of instruction codes is stored, said series of instruction codes running on said first information processor so as to realize:

a format changer changing the format of a channel message to a format defined in said MIDI protocols for at least one system message, a cipher manager enciphering said pieces of regular music data to pieces of enciphered music data, and a writer memorizing said pieces of enciphered music data in a data field of said format for said at least one system message;

a music producer including a second information processor having an information processing capability and a program memory storing another series of instruction codes, said other series of instruction codes running on said second information processor so as to realize:

a restorer restoring said pieces of enciphered music data in said system message to said pieces of regular music data, and a sound generator producing said music sound on the basis of said pieces of regular music data; and a data transporter for transporting said at least one system message from said music data source to said music producer.

2. The music system as set forth in claim 1, in which said at least one system message is a maker exclusive message.

3. The music system as set forth in claim 2, in which a piece of status representative of a header, a maker identification code, a device identification code, a parity code and another piece of status representative of a footer are further memorized in said maker exclusive message.

4. The music system as set forth in claim 2, in which said channel messages have respective pieces of event data and respective pieces of time data each representative of a lapse of time from previous event, and said pieces of time data are encoded to pieces of encoded time data for restricting the number of bits representing the lapse of time.

5. The music system as set forth in claim 1, in which said music data source includes a packet generator loading said at least one system message into a packet, and said packet generator transmits said packet to said music producer through a communication channel serving as said data transporter.

6. The music system as set forth in claim 5, in which said music data source further includes a dummy packet generator producing a dummy packet or dummy packets, said dummy packet generator transmits said dummy packet or dummy packets to said music producer through said communication channel while said music data source is standing idle for a long time period after a transmission of the previous packet.

* * * * *